US007404418B1

(12) United States Patent
Olatunbosun

(10) Patent No.: US 7,404,418 B1
(45) Date of Patent: Jul. 29, 2008

(54) WATER MIXING APPARATUS

(76) Inventor: Solomon B. Olatunbosun, 33 Cam Court Bidbury Close, London SE15 6AG (GB)

( * ) Notice: Subject to any disclaimer, the term of this patent is extended or adjusted under 35 U.S.C. 154(b) by 280 days.

(21) Appl. No.: 11/299,177

(22) Filed: Dec. 12, 2005

(51) Int. Cl.
*B01F 7/18* (2006.01)

(52) U.S. Cl. ..... 137/897; 366/165.3; 366/168.2

(58) Field of Classification Search ..... 137/896, 137/897; 366/165.3, 168.2
See application file for complete search history.

(56) References Cited

U.S. PATENT DOCUMENTS 508,584 A * 11/1893 Stevens ..... 366/165.3
1,156,409 A * 10/1915 Klein ..... 366/168.2
D72,243 S 3/1927 Shore
1,636,127 A * 7/1927 Fickle ..... 366/165.3
3,053,277 A 9/1962 Bahrani
3,807,453 A 4/1974 Dom et al.
4,609,007 A 9/1986 Uhl
4,711,392 A 12/1987 Kidouchi et al.
6,227,246 B1 5/2001 Hall et al.

* cited by examiner

*Primary Examiner*—Stephen M Hepperle

(57) ABSTRACT

A water mixing apparatus mixing hot and cold water includes a housing that includes top wall and a peripheral wall that is attached to and extends downwardly from the top wall. A bottom wall is removably attached to a bottom edge of the peripheral wall for selectively opening or closing the housing. An inlet is fluidly coupled to and extends through the peripheral wall. A nozzle portion of the inlet extends away from the peripheral wall. The nozzle portion is adapted for removably coupling with a water supply. The inlet is angled such that the inlet is directed away from a central area of the housing. A pour spout is fluidly coupled to the top wall. Water may enter the housing through the inlet such that the stirring assembly blends the water.

11 Claims, 6 Drawing Sheets

WATER MIXING APPARATUS

BACKGROUND OF THE INVENTION

1. Field of the Invention

The present invention relates to water mixing devices and more particularly pertains to a new water mixing device for mixing hot and cold water so that it dispenses from a shower or other spout in a more uniform manner.

2. Description of the Prior Art

The use of water mixing devices is known in the prior art. U.S. Pat. No. 3,807,456 describes a single lever mixing faucet. Another type of water mixing device is U.S. Pat. No. 6,227,246 having an electronic valve assembly for selectively mixing hot and cold water.

While these devices fulfill their respective, particular objectives and requirements, the need remains for a device that better mixes water so that the temperature is uniform across the stream of water as it exits a spout.

SUMMARY OF THE INVENTION

The present invention meets the needs presented above by generally comprising a housing that includes top wall and a peripheral wall that is attached to and extends downwardly from the top wall. A bottom wall is removably attached to a bottom edge of the peripheral wall for selectively opening or closing the housing. An inlet is fluidly coupled to and extends through the peripheral wall. A nozzle portion of the inlet extends away from the peripheral wall. The nozzle portion is adapted for removably coupling with a water supply. The inlet is angled such that the inlet is directed away from a central area of the housing. A pour spout is fluidly coupled to the top wall. Water may enter the housing through the inlet such that the stirring assembly blends the water.

The invention is also found in a housing that includes a top wall and a peripheral wall that is attached to and extends downwardly from the top wall. A bottom wall is removably attached to a bottom edge of the peripheral wall for selectively opening or closing the housing. An inlet is fluidly coupled to and extends through the peripheral wall. A nozzle portion of the inlet extends away from the peripheral wall. The nozzle portion is adapted for removably coupling with a water supply. The inlet is angled such that the inlet is directed away from a central area of the housing. A shower spout coupler is fluidly coupled to the top wall and extends upwardly therefrom. The shower spout coupler is threaded. Water may enter the housing through the inlet such that the stirring assembly blends the water.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
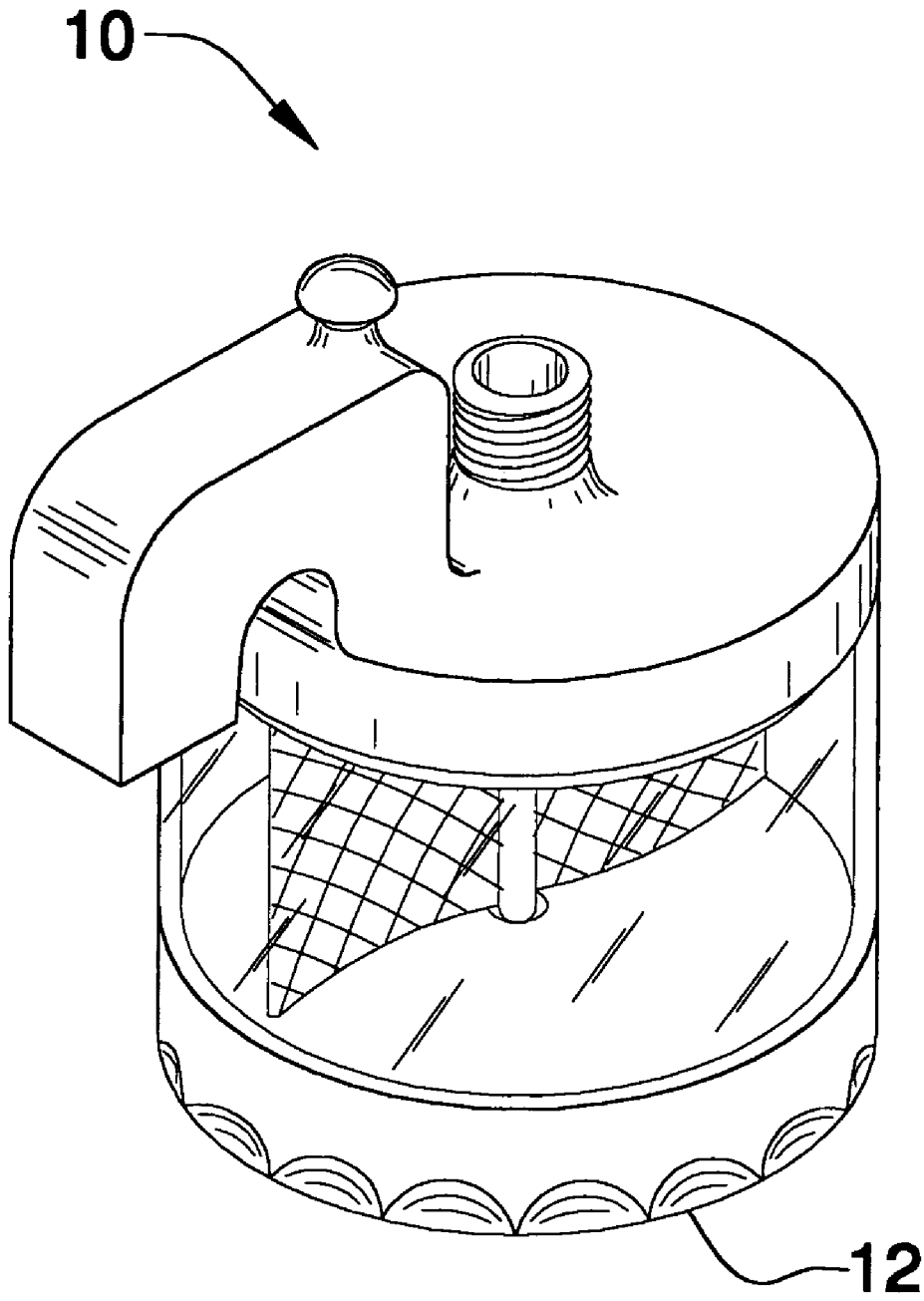
FIG. 1 is a perspective view of a water mixing apparatus according to the present invention.
Figure 2:
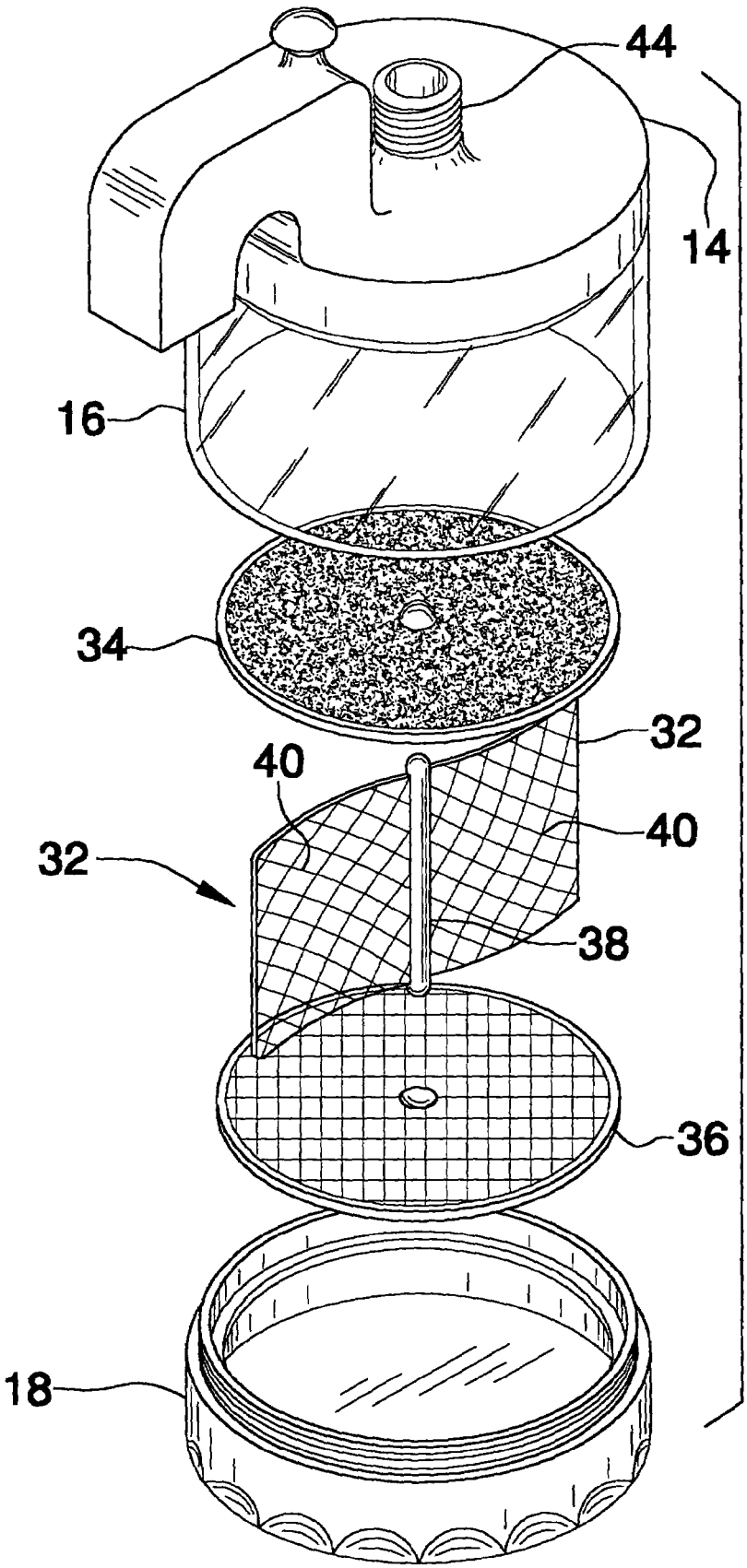
FIG. 2 is a broken perspective view of the present invention.

With reference now to the drawings, and in particular to FIGS. 1 through 8 thereof, a new water mixing device embodying the principles and concepts of the present invention and generally designated by the reference numeral 10 will be described.

As best illustrated in FIGS. 1 through 8, the water mixing apparatus 10 generally comprises a housing 12 that includes a top wall 14 and a peripheral wall 16 that is attached to and extends downwardly from the top wall 14. A bottom wall 18 is removably attached to a bottom edge of the peripheral wall 16 for selectively opening or closing the housing 12. The peripheral wall 16 preferably has a substantially tubular shape.

An inlet 20 is fluidly coupled to and extends through the peripheral wall 16. A nozzle portion 22 of the inlet 20 extends away from the peripheral wall 16. The nozzle portion 22 is adapted for removably coupling with a water supply. The nozzle portion 22 can be coupled to a conventional water supply pipe or a particular water supply having a threaded outlet 24. The water supply includes a cold water attachment 26 and a hot water attachment 28. In particular, it is preferred that the inlet 20 is attached to a water connection of a bathtub or shower. The inlet 20 is angled such that the inlet 20 is directed away from a central area of the housing 12. This causes water entering the housing 12 to move around the periphery of the housing 12 to better mix the water.

Figure 3:
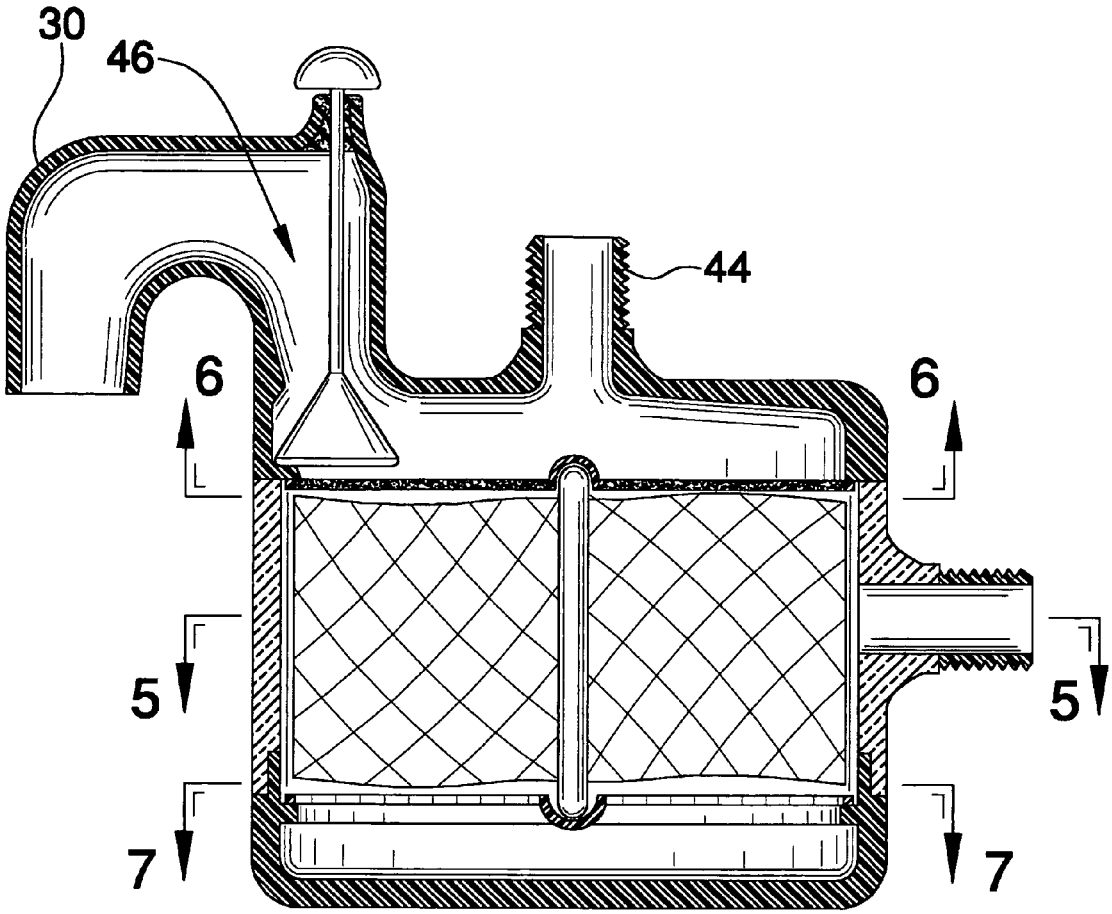
FIG. 3 is a side cross-sectional view of the present invention.
Figure 4:
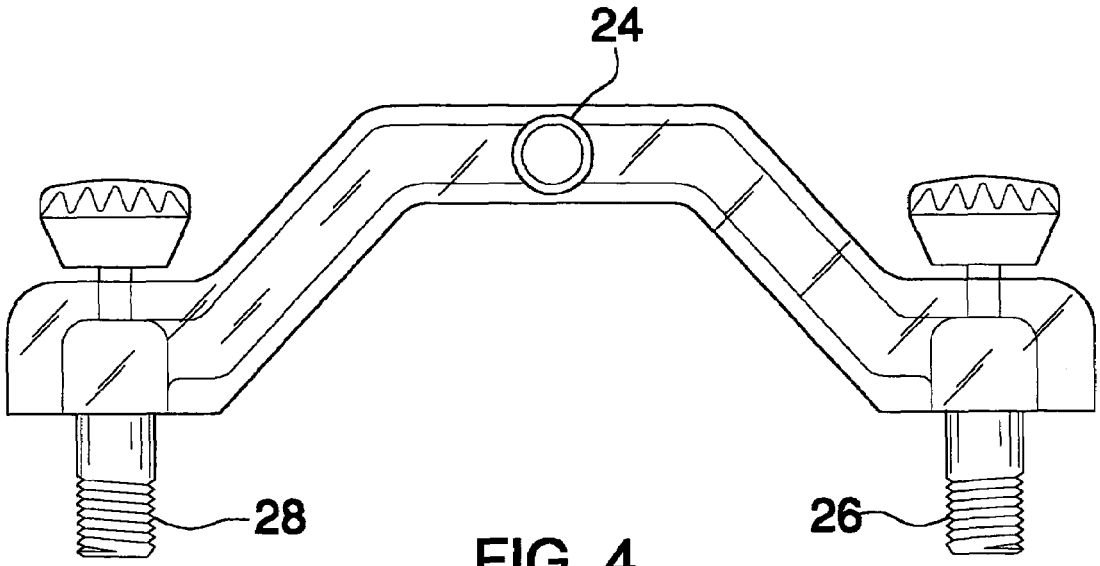
FIG. 4 is a front view of a water supply of the present invention.
Figure 5:
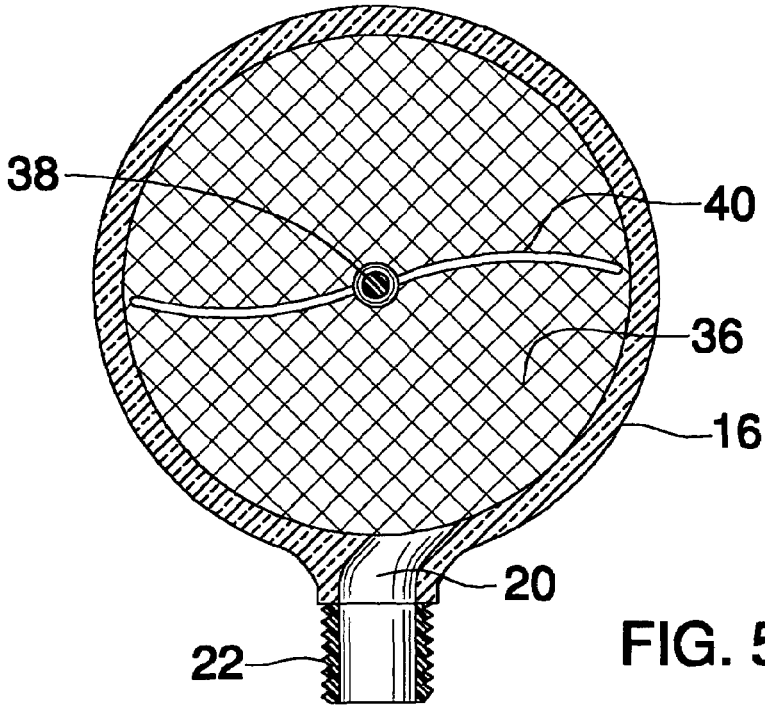
FIG. 5 is a cross-sectional view taken along line 5-5 of FIG. 3 of the present invention.
Figure 6:
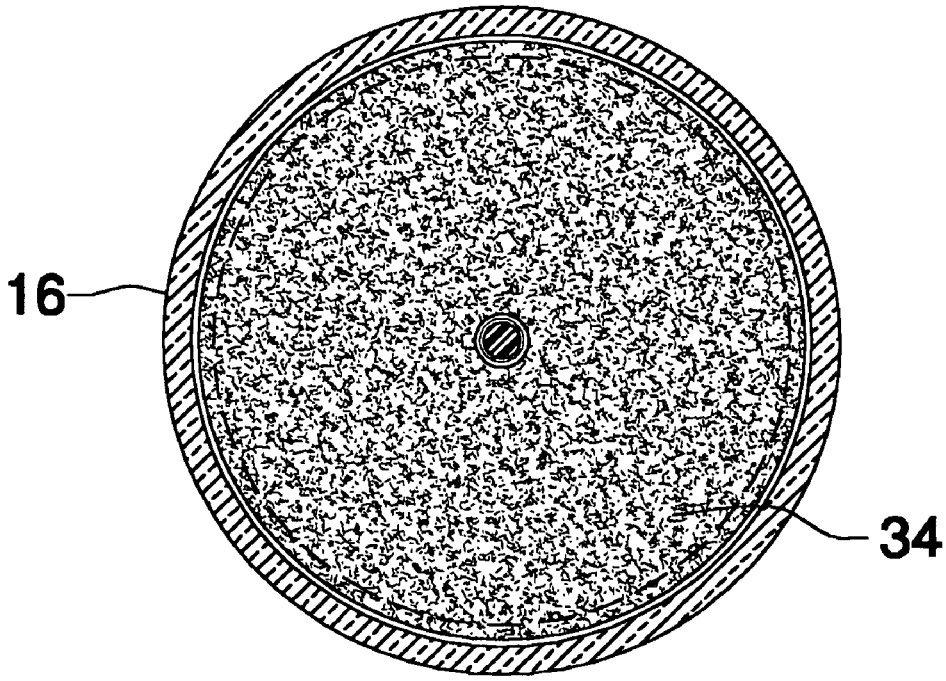
FIG. 6 is a cross-sectional view taken along line 6-6 of FIG. 3 of the present invention.
Figure 7:
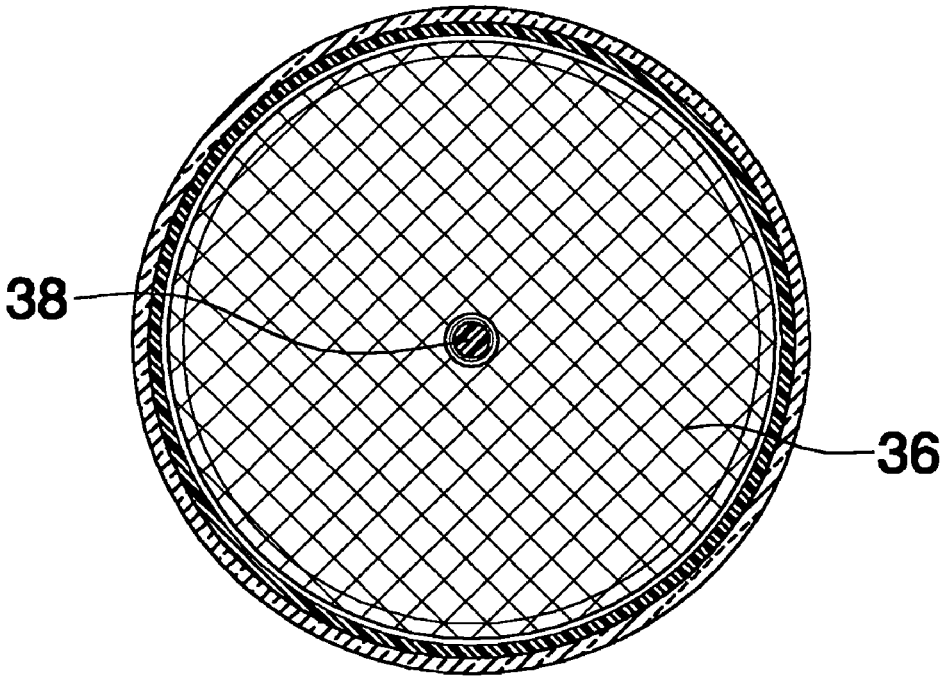
FIG. 7 is a cross-sectional view taken along line 7-7 of the present invention.
Figure 8:
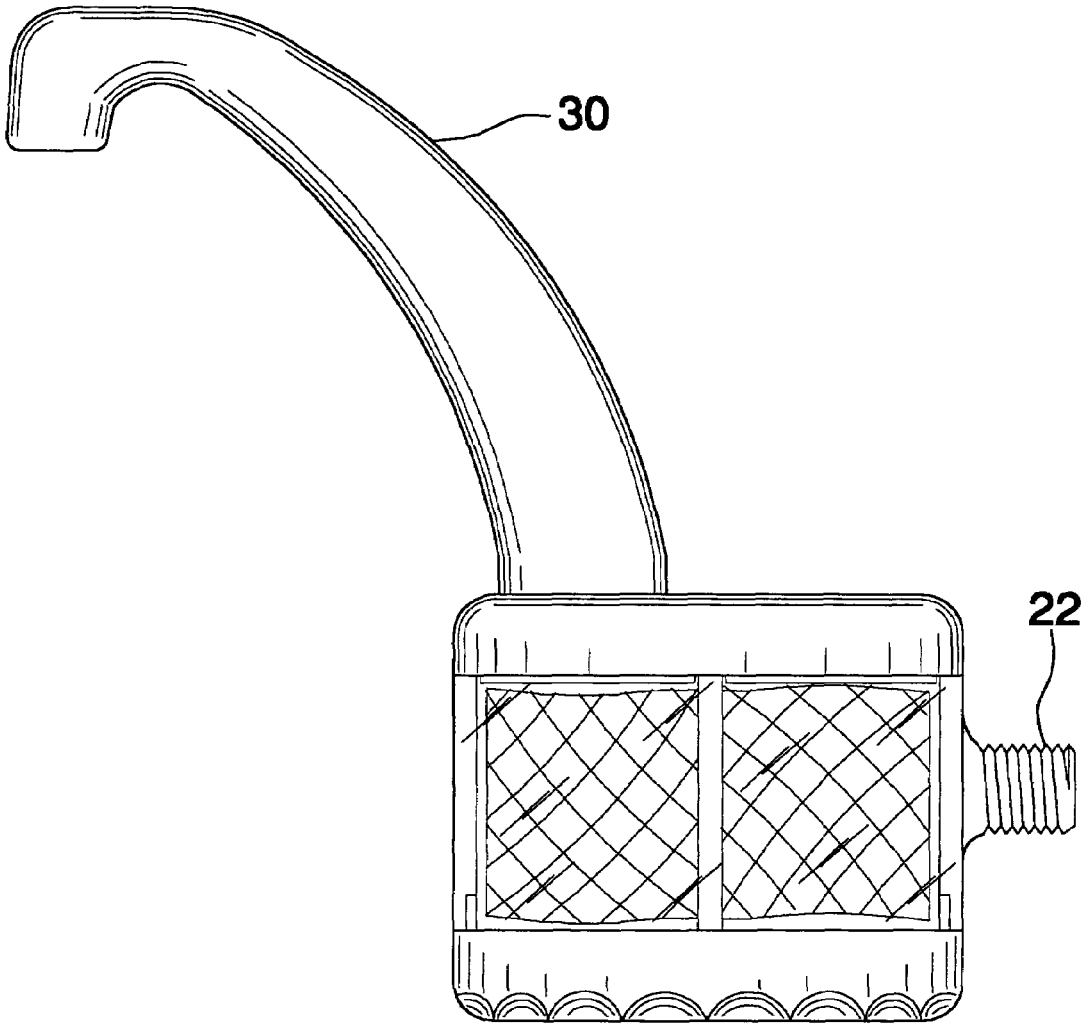
FIG. 8 is a side view of a second embodiment of the present invention.

A pour spout 30 is fluidly coupled to the top wall 14. The pour spout 30 may be a conventionally shaped pour spout such as shown in FIG. 3 or it may include a more dramatic rise as shown in FIG. 8 so that it may be more easily used for washing hair and the like.

A stirring assembly 32 is mounted within the housing 12 for mixing water position within the housing 12. The stirring assembly 32 includes an upper support 34 that is mounted within the housing 12 and positioned adjacent to the top wall 14 and a lower support 36 that is mounted in the housing 12 and is positioned adjacent to the bottom wall 18. A post 38 extends between and is rotatably coupled to the upper 34 and lower 36 supports. A plurality of panels 40 is attached to the post 38 and extends away therefrom. The panels 40 may be solid or screen members. Each of the panels 40 is curved from the post 38 to an outer edge 42 of each of the panels 40. The plurality of panels 40 preferably includes a pair of panels 40 that are positioned generally opposite of each other. The bottom support 36 includes a mesh screen spaced from the bottom wall 18 and the top support 34 includes a water permeable plate. The mesh screen allows for heavy particles to fall to the bottom wall and the water permeable plate aids in filtering the water before it leaves through the pour spout 30.

In addition to the pour spout 30, or in place of the pour spout 30, is a shower spout coupler 44 that is fluidly coupled to the top wall 14 and extends upwardly therefrom. The shower spout coupler 44 is threaded. This allows for a conventional hose to be coupled to the shower spout coupler 44 so that the hose can deliver water from the housing 12 to a showerhead fluidly coupled to the hose.

A stopper assembly 46, or water diverter, is mounted in the pour spout 30 for selectively opening or closing the pour spout 30. The stopper assembly 46 is conventional of the type used in faucets to direct water from a bathtub spout to a shower spout. The stopper assembly 46 allows the user to determine if the water will flow outwardly of the pour spout 30 or the shower spout outlet 44.

In use, water is allowed to enter the housing 12 through the inlet 20. The flow of the water flows around the housing 12 which allows the cold and hot water to more fully mix. The mixing assembly 32 aids the mixing process. As the water flows out of either the pour spout 30 or the shower spout coupler 44, the water is of uniform temperature across either the pour spout 30 or the shower spout coupler 44.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water mixing apparatus for combining hot water and cold water, said apparatus including:

a housing including a top wall and a peripheral wall being attached to and extending downwardly from said top wall, a bottom wall being removably attached to a bottom edge of said peripheral wall for selectively opening or closing said housing;

an inlet fluidly coupled to and extending through said peripheral wall, a nozzle portion of said inlet extending away from said peripheral wall, said nozzle portion being adapted for removably coupling with a water supply, said inlet being angled such that said inlet is directed away from a central area of said housing;

a pour spout being fluidly coupled to said top wall;

a stirring assembly being mounted within said housing for mixing water positioned within said housing, stirring assembly including an upper support being mounted within said housing and positioned adjacent to said top wall, a lower support being mounted in said housing and being positioned adjacent to said bottom wall, a post extending between and being rotatably coupled to said upper and lower supports, a plurality of panels being attached to said post and extending away therefrom, said lower support including a mesh screen spaced from said bottom wall and said top support includes a water permeable material; and wherein water may enter said housing through said inlet such that said stirring assembly blends the water.

2. The apparatus according to claim 1, wherein said peripheral wall has a substantially tubular shape.

3. The apparatus according to claim 1, each of said panels being curved from said post to an outer edge of each of said panels.

4. The apparatus according to claim 3, wherein said plurality of panels includes a pair of panels being positioned generally opposite of each other.

5. The apparatus according to claim 3, further including a shower spout coupler being fluidly coupled to said top wall and extending upwardly therefrom, said shower spout coupler being threaded, a stopper assembly being mounted in said pour spout for selectively opening or closing said pour spout.

6. The apparatus according to claim 1, further including a shower spout coupler being fluidly coupled to said top wall and extending upwardly therefrom, said shower spout coupler being threaded, a stopper assembly being mounted in said pour spout for selectively opening or closing said pour spout.

7. A water mixing apparatus for combining hot water and cold water, said apparatus including:

a housing including a top wall and a peripheral wall being attached to and extending downwardly from said top wall, a bottom wall being removably attached to a bottom edge of said peripheral wall for selectively opening or closing said housing;

an inlet being fluidly coupled to and extending through said peripheral wall, a nozzle portion of said inlet extending away from said peripheral wall, said nozzle portion being adapted for removably coupling with a water supply, said inlet being angled such that said inlet is directed away from a central area of said housing;

a shower spout coupler being fluidly coupled to said top wall and extending upwardly therefrom, said shower spout coupler being threaded;

a stirring assembly being mounted within said housing for mixing water positioned within said housing, said stirring assembly including an upper support being mounted within said housing and positioned adjacent to said top wall, a lower support being mounted in said housing and being positioned adjacent to said bottom wall, a post extending between and being rotatably coupled to said upper and lower supports, a plurality of panels being attached to said post and extending away therefrom, said lower support includes a mesh screen spaced from said bottom wall and said top support includes a water permeable material; and wherein water may enter said housing through said inlet such that said stirring assembly blends the water.

8. The apparatus according to claim 7, wherein said peripheral wall has a substantially tubular shape.

9. The apparatus according to claim 7, each of said panels being curved from said post to an outer edge of each of said panels.

10. The apparatus according to claim 9, wherein said plurality of panels includes a pair of panels being positioned generally opposite of each other.

11. A water mixing apparatus for combining hot water and cold water, said apparatus including:

a housing including a top wall and a peripheral wall being attached to and extending downwardly from said top wall, a bottom wall being removably attached to a bottom edge of said peripheral wall for selectively opening or closing said housing, said peripheral wall having a substantially tubular shape;

an inlet being fluidly coupled to and extending through said peripheral wall, a nozzle portion of said inlet extending away from said peripheral wall, said nozzle portion being adapted for removably coupling with a water supply, said inlet being angled such that said inlet is directed away from a central area of said housing;

a pour spout being fluidly coupled to said top wall;

a stirring assembly being mounted within said housing for mixing water position within said housing, said stirring assembly including an upper support being mounted within said housing and positioned adjacent to said top wall, a lower support being mounted in said housing and being positioned adjacent to said bottom wall, a post extending between and being rotatably coupled to said upper and lower supports, a plurality of panels being attached to said post and extending away therefrom, each of said panels being curved from said post to an outer edge of each of said panels, said plurality of panels including a pair of panels being positioned generally opposite of each other, said bottom support including a mesh screen spaced from said bottom wall, said top support including a water permeable plate;

a shower spout coupler being fluidly coupled to said top wall and extending upwardly therefrom, said shower spout coupler being threaded;

a stopper assembly being mounted in said pour spout for selectively opening or closing said pour spout; and wherein water may enter said housing through said inlet such that said stirring assembly blends the water.

* * * * *